United States Patent [19]

Li et al.

[11] Patent Number: 4,686,451

[45] Date of Patent: Aug. 11, 1987

[54] GAAS VOLTAGE REFERENCE GENERATOR

[75] Inventors: Jim Y. Li; Frederick G. Weiss, both of Portland, Oreg.

[73] Assignee: Triquint Semiconductor, Inc., Beaverton, Oreg.

[21] Appl. No.: 919,284

[22] Filed: Oct. 15, 1986

[51] Int. Cl.[4] ..... G05F 3/20

[52] U.S. Cl. ..... 323/313; 323/229; 323/907; 307/297

[58] Field of Search ..... 323/313, 907, 229, 281, 323/311, 312; 307/296 R, 297, 317 A

[56] References Cited

U.S. PATENT DOCUMENTS

| | | | |
|---|---|---|---|
| 3,577,167 | 5/1971 | Avins | 307/297 X |
| 4,278,929 | 7/1981 | Lee et al. | 323/311 |
| 4,433,283 | 2/1984 | Gersbach | 307/297 X |
| 4,477,737 | 10/1984 | Ulmer et al. | 307/297 |
| 4,524,318 | 6/1985 | Burnham et al. | 323/313 |
| 4,542,331 | 9/1985 | Boyer | 323/313 |
| 4,641,081 | 2/1987 | Sato et al. | 323/313 |

*Primary Examiner*—Patrick R. Salce
*Assistant Examiner*—Marc S. Hoff
*Attorney, Agent, or Firm*—William S. Lovell; Alexander C. Johnson, Jr.

[57] ABSTRACT

In a GaAs integrated circuit, a voltage reference generator includes a pair of Schottky diodes and a first, current-source connected, depletion-mode MESFET coupled in series to conduct current from a ground node to a voltage supply node. The current-source connected FET causes a constant current to flow from the ground node through the diodes, producing a constant voltage drop which generates a constant reference voltage at a reference node between the diodes and FET. A second pair of Schottky diodes is connected in series between the source of the FET and the voltage supply node, in a loop coupling the source to the gate of the FET, to provide a voltage difference Vgs across the FET proportional to voltage drop across the second pair of diodes. This voltage difference varies with fabrication process and temperature variations and causes the first FET to modify the amount of current flow to compensate so as to maintain a constant voltage drop across the first pair of diodes. A second FET is connected between the reference node and the first, current-source connected FET and has its gate coupled to the source of the first FET, either directly or through one of the second pair of diodes. Any variations in supply voltage are transmitted to the drain of the first FET to maintain a constant voltage Vds and current Ids, thereby stabilizing the reference voltage against supply voltage variations and noise.

15 Claims, 5 Drawing Figures

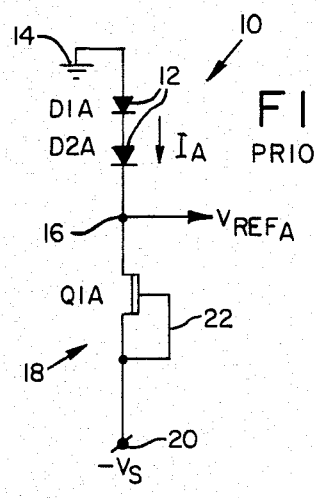
FIG. 1
PRIOR ART
FIG. 2
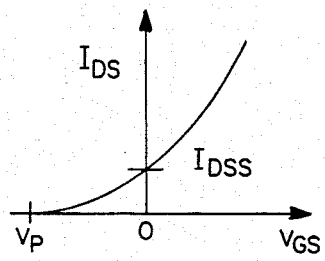
FIG. 3
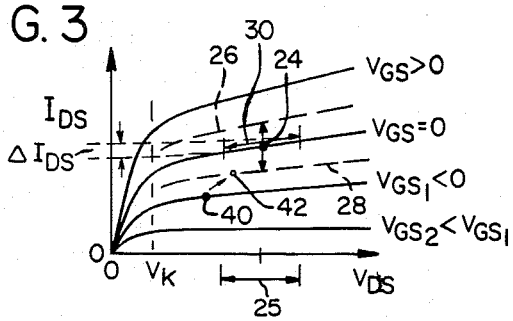
FIG. 4
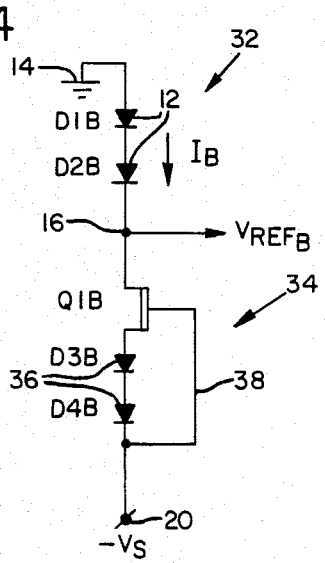
FIG. 5
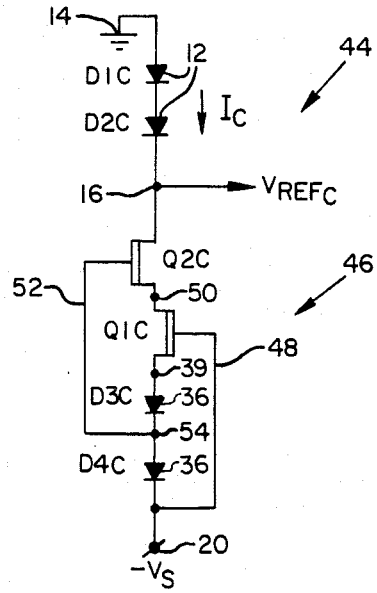

GAAS VOLTAGE REFERENCE GENERATOR

BACKGROUND OF THE INVENTION

This invention relates generally to gallium arsenide (GaAs) integrated circuits and more particularly to a GaAs voltage reference generator.

The need for stable on-board voltage references in an integrated circuit is well known. Silicon integrated circuits usually exploit the stability of the band gap and are implemented with a junction diode and operational amplifiers. One example of a band gap reference circuit implemented in silicon is illustrated in P. R. Gray, et al., *Analysis and Design of Analog Integrated Circuits.* Second Edition (1984), page 736. Other examples of IC voltage regulators implemented in silicon are illustrated in R. J. Widlar, "New Developments in IC Voltage Regulators," IEEE Journal of Solid-State Circuits, Vol. SC-6, #1, Feb. 1971.

In a GaAs MESFET integrated circuit, the circuit designer must use Schottky diodes instead of PN junctions, which are unavailable in GaAs MESFET integrated circuit technology. FIG. 1 in the drawings shows a GaAs integrated circuit representative of the prior art, showing reference diodes D1A, D2A, carrying current $I_A$ developed by current-source connected FET Q1A. Inasmuch as current source Q1A is a depletion-mode device having a pinchoff voltage Vp less than 0 volts, current flows even though the gate-to-source voltage Vgs=0 (see FIG. 2).

This circuit has several drawbacks. The output reference voltage, VrefA, is subject to a wide range of variation due to operating temperature shifts and GaAs integrated-circuit-process variations. It is also sensitive to supply voltage variations and noise on the power supply line, −Vs, due to the slope of the Ids vs. Vds characteristic curves, illustrated in FIG. 3. Temperature variations affect operation of both the Schottky diodes and the current source.

Considering the current source, as operating temperature increases, carrier mobility drops and current decreases. This reduces the voltage drop across the diodes and thereby decreases the reference voltage VrefA. Similarly, as the power supply voltage −Vs changes, the current changes: FET Q1A is not a perfect current source. The power supply voltage −Vs is nominally −5 volts but in GaAs integrated circuitry can range from −4 to −6 volts. A 1 volt shift can produce as high as 50 millivolts of change in VrefA.

The diodes are also affected by variations in temperature and fabrication process. For example, as temperature increases, the voltage drop across the diodes decreases for a constant current $I_A$. This variation, coupled with the temperature sensitivity of a current source Q1a, compounds the sensitivity of VrefA to temperature variations. Such voltage variations have been observed to be as much as +/−250 millivolts.

Gallium-arsenide integrated circuits are much more susceptible to process variations than silicon integrated circuits. GaAs is not a monocrystalline solid, as is silicon, and GaAs fabrication processes have not attained the level of sophistication that silicon processes have attained. The series resistance of the Schottky diodes can vary as much as +/−50%, depending on doping concentrations and the purity of materials used in the GaAs fabrication process.

Experience in the silicon integrated circuit technology is essentially inapplicable to gallium-arsenide technology. Diodes and current source-connected FETs are required in GaAs technology because of the inability to produce a stable high gain amplifier, using a band gap reference, as in silicon, because GaAs FETs are inherently low gain devices.

Accordingly, a need remains for a simple, stable and more accurate GaAs voltage reference generator.

SUMMARY OF THE INVENTION

One object of the invention is to stabilize the temperature-performance of a GaAs voltage reference generator.

A second object of the invention is to minimize the effects of process variations on the accuracy of a GaAs voltage reference generator.

Another object of the invention is to reduce the sensitivity of a GaAs voltage reference generator to supply voltage variations and noise.

In a GaAs integrated circuit, a voltage reference generator includes a first voltage dropping means, such as a pair of Schottky diodes, and a first, current-source connected, depletion-mode FET coupled in series to conduct current from a ground node to a voltage supply node. Ideally, but not in practice, the current-source connected FET causes a constant current to flow from the ground node through the diodes, producing a constant voltage drop which generates a constant reference voltage at a reference node between the diodes and FET.

According to the invention, a second voltage dropping means is connected in series between the source of the first FET and the voltage supply node, in a loop coupling the source to the gate of the FET, to provide a voltage difference Vgs across the FET proportional to the voltage drop across the second pair of diodes. This voltage difference varies with fabrication process and temperature variations and causes the first FET to modify the amount of current flow to compensate so as to maintain a constant voltage drop across the first voltage dropping means.

In a preferred embodiment, a second FET is connected between the reference node and the first, current rent-source connected FET. Its gate is biased proportionally to the supply voltage, for example, by coupling it to the source of the first FET, either directly or through one of the diodes of the second voltage dropping means. Any variations in supply voltage are effectively transmitted to the drain of the first FET to maintain a constant voltage Vds and current Ids, thereby stabilizing the reference voltage against supply voltage variations and noise.

Other objects, features and advantages of the invention will become more readily apparent from the following detailed description of a preferred embodiment which proceeds with reference to the accompanying drawings.

BRIEF DESCRIPTION OF DRAWINGS

FIG. 1 is a GaAs voltage reference generator circuit that is representative of the prior art.

FIG. 2 is a graph of Ids vs. Vgs for a depletion mode, current-source connected GaAs FET.

FIG. 3 is a graph of the Ids vs. Vds characteristic curves for a depletion-mode, current-source connected GaAs FET.

FIG. 4 is a circuit diagram of one embodiment of GaAs voltage reference generator in accordance with the invention.

FIG. 5 is a diagram of a second, preferred embodiment of a GaAs voltage reference generator in accordance with the invention.

DETAILED DESCRIPTION

In the circuit of FIG. 1, a GaAs voltage reference generator 10 representative of the prior art comprises a pair of Schottky diodes 12 (D1A, D2A) connected in series to conduct current $I_A$ from ground 14 to a reference voltage node 16 (VrefA). Current flow from ground through the diodes is induced by a "constant-current" source 18 connected in series with node 16 to a power supply voltage node 20, biased to provide a power supply voltage −Vs. The "constant current" source is a current-source connected GaAs FET Q1A, having its source coupled by a conductor 22 to its gate.

Referring to FIG. 2, GaAs FET Q1A is a depletion-mode device having a pinchoff voltage Vp<0 volts. Consequently, a current Idss flows even though the gate-to-source voltage Vgs=0. The Schottky diodes 12 each provide a voltage drop which is nominally 0.65 volts, but can vary with temperature and process variations over a range that is commonly 0.6 to 0.7 volts and can be as much as 0.8 volts. The power supply voltage −Vs at node 20 is nominally −5 volts but can commonly range from −4 volts to −6 volts. Assuming nominal values, the reference voltage VrefA at node 16, using two Schottky diodes D1a, D2a, is nominally −1.3 volts. Within the foregoing ranges, however, the reference voltage produced by circuit 10 commonly has a +/−250 millivolt range of variation about the nominal −1.3 volts.

The "constant-current" source 18 is appropriately modeled by a true constant-current source transmitting a constant current, nominally of 1 milliampere, in parallel with a resistor. Referring to FIG. 3, the slope of the curve Vgs=0 at operating point 24 defines the equivalent resistance of "constant current" source 18, for example, 10 kilohms. Under these nominal operating conditions, the GaAs FET Q1A operates at an operating point 24 corresponding to a nominal drain-to-source voltage Vds=3.7 volts on the curve Vgs=0.

Under the influence of temperature and process variations, the Vgs=0 curve can move up or down, as indicated by dashed curves 26, 28, causing like variations in the drain-to-source current Ids through device Q1a. A temperature increase causes carrier mobility to decrease, in turn causing operation of the device to shift downward to curve 28. The slope of that curve decreases relative to the slope at point 24, corresponding to an increase in equivalent resistance across "constant current" source 18, thereby introducing a second order effect on current IA. Conversely, a decrease in temperature shifts operation upward to curve 26, effecting a decrease in equivalent resistance.

As mentioned above, these influences can cause the reference voltage VrefA at node 16 to vary, even if the power supply voltage remains constant. Such voltage does not, however, remain constant, but can vary over a range that is commonly +/−1 volt about a nominal −5 volts. This variation causes a corresponding variation in Vds, as indicated by arrow 25. As Vds varies, it shifts operating point 24 along the Vgs curve by a corresponding amount. Since the Vgs=0 curve has a positive slope, corresponding to a non-infinite equivalent resistance in the constant current source model, current Ids also varies due to power supply voltage variations. This effect is illustrated by arrow 30 along the curve Vgs=0 and associated dashed lines extending to the vertical axis to indicate a change in Ids as a function of change in Vds.

Referring to FIG. 4, a diode voltage reference generator 32 in accordance with the invention is arranged to compensate for temperature and process variations to help stabilize the reference voltage VrefB. Like circuit 10, circuit 32 uses a pair of Schottky diodes 12 connected in series between ground 14 and reference voltage node 16. Instead of "constant current" source 18 as in circuit 10, circuit 32 employs a current source 34 with diode degeneration in its source, in series between node 16 and power supply node 20. Current source 34 employs a depletion-mode GaAs FET Q1B in series with a second pair of Schottky diodes 36, individually identified as diodes D3B and D4B. These diodes are essentially identical in structure and fabrication process used to form them as diodes 12. Diodes 36 are also preferably located near diodes 12 on a GaAs integrated circuit chip so that both pairs are subjected to like process and temperature variations.

A conductor 38 connects power supply node 20 to the gate of GaAs FET Q1B. The source of FET Q1B is thereby coupled to its gate through diodes 36. Because diodes 36 are connected in series between the source and gate of GaAs FET Q1B, through connector 38, the voltage Vgs across GaAs FET Q1B does not equal zero, but is less than zero by the amount of the voltage drop across diodes 36. Since the gate of GaAs FET Q1B is coupled to node 20, nominally at −5 volts, and the diode voltage drop is 1.3 volts, the gate-to-source voltage Vgs=−1.3 volts so that the device operates along the $Vgs_1<0$ curve in FIG. 3. Also as a result of the voltage drop across diodes 36, the operating point of device Q1B is shifted downward to an operating point 40 on the curve $Vgs_1<0$, to a nominal voltage Vds of about 2.6 volts. As long as this voltage remains above the knee voltage $V_k$ for the device, operation along the Vgs curve remains essentially linear.

In operation, the addition of diodes 36 substantially compensates for temperature and process variations in the operations of circuit 32, to stabilize reference voltage VrefB. Assume, for example, that a process variation causes the voltage drop across a pair of diodes in series to decrease from a nominal 1.3 volts to 1.2 volts. Both sets of diodes 12, 36 are subject to the same process variations. A decrease in decrease in voltage drop across diodes 36. This, in turn causes an increase in voltage Vgs in FET Q1B of current source 34, for example, from a nominal −1.3 volts to −1.2 volts.

Referring to FIG. 3, this change corresponds to an upward shift in the $Vgs_1$ curve, and an increase of voltage Vds, to a new operating point 42. Current Ids at the new operating point is greater than such current at operating point 40 and thus tends to increase current $I_B$ through diodes 12 to node 16. This increase in current is accompanied by a corresponding increase of voltage drop across diodes 12, tending to shift the reference voltage VrefB back to the nominal voltage of −1.3 volts.

Diodes 12, 36, being formed in the same chip and preferably being as close together as possible, are likewise subject to the same temperature variations. As temperature increases, the voltage drop across the pairs of diodes tends to decrease. Since voltage drop decreases equally for both sets of diodes 12, 36, the same sort of shift of operating point from operating point 40 to point 42 as previously described will occur, again increasing current Ids and thereby increasing current $I_B$ through diodes 12 to aid in stabilizing the reference voltage VrefB at a nominal −1.3 volts. The voltage reference generator 32 of FIG. 4 nonetheless remains susceptible to variations in power supply voltage −Vs.

Referring to FIG. 5, a second embodiment of the invention is a GaAs voltage reference generator 44 which additionally compensates for variations in power supply voltage. Circuit 44 employs the same diodes 12 in series between a ground node 14 and reference node 16 as in the previously-discussed circuits. The current source is modified, however, to provide a cascaded current source 46 with diode degeneration in its source. This current source includes a GaAs FET Q1C, corresponding to device Q1B in FIG. 4, having a pair of diodes 36 (D3C and D4C) connected in series between its source and power supply voltage node 20. A conductor 48 couples power supply voltage node 20 to the gate of device Q1C.

In addition to these elements, current source 46 includes a second GaAs FET Q2C connected in series between node 16 and device Q1C, with its source coupled to the drain of device Q1C at node 50. The gate of device Q2C is coupled via a conductor 52 to node 54 between diode D3C and diode D4C. Optionally, this conductor can be connected to the source 39 of device Q1C, for example, if only one diode 36 is used in series with the source of device Q1C.

In operation, FET Q2C serves to maintain the drain-to-source voltage (Vds of FET Q1C) esentially constant, notwithstanding variations in power supply voltage, −Vs. Assuming a substantially constant voltage drop between nodes 54 and 20, the gate bias Vg of FET Q2C varies directly with power supply variations. Considering the effects of such variations around the loop formed by conductor 52, because the voltage drop across diode D3C is essentially constant, an increase of Vg for FET Q2C causes a corresponding increase in Vd for device Q1C, which serves to maintain the net drain-to-source voltage Vds of device Q1C essentially constant. This effect of device Q2C and conductor 52 compensates for the effect of variations in supply voltage on Vds across FET Q1C to help maintain current Ids constant. As current Ids remains constant, so too does current $I_C$, to maintain a voltage drop across diodes 12 and a reference voltage VrefC that are essentially constant, that is, are invariant with supply voltage variations or noise.

Tests of an operative device of the preferred embodiment of FIG. 5 have demonstrated Vss supply rejection in excess of 50 dB and a temperature coefficient of less than one millivolt per degree C, over the range of −5° C. to +100° C.

Having illustrated and described the principles of our invention in two embodiments thereof, it will be appreciated by those skilled in the art that the invention may be modified in arrangement and detail without departing from such principles. For example, although the preferred embodiment disclosed herein employs two diodes in series as each voltage dropping means, other arrangements can be used. The two-diode circuit provides a −1.3V reference, but other values (e.g., −0.65V, −1.95V, etc.) are all realizable and at times desirable. Similarly, the number of diodes used in each voltage dropping means need not be identical, e.g., the embodiment of FIG. 5 will work without one of diodes D3C or D4C, although temperature compensation would be degraded. Similarly, a resistor can be substituted for one of diodes D3C or D4C, reducing sensitivity of current $I_C$ to process-related variations in FET parameters with same loss of temperature compensation. We claim all modifications coming within the scope and spirit of the following claims.

We claim:

1. In a GaAs integrated circuit, a GaAs voltage reference generator comprising:

a first diode means connected to conduct current from a nominal ground node to a voltage reference node;

a depletion-mode FET connected in series with the first diode means, the FET having a gate, a drain coupled to the reference node and a source coupled to a voltage supply node;

conductor means coupling the gate of the FET to the voltage supply node for current-source connecting the FET to cause a current to flow between the ground node and the voltage supply node, the current being substantially constant for a constant voltage difference between the gate and source of the FET and a constant operating temperature of the integrated circuit; and a second diode means connected to conduct current from the source of the FET to the voltage supply node;

each of the diode means being operative to produce a voltage drop which varies within a predetermined range as a function of at least one of integrated circuit temperature and fabrication process variations;

the second diode means being coupled in a loop including the FET and the conductor means for determining and varying said voltage difference proportionally to the voltage drop of the second diode means;

the current-source connected FET being responsive to a variation in said voltage difference to vary said current so as to compensate for a variation in voltage drop across the diode means due to temperature or process variations and thereby provide a predetermined voltage at the voltage reference node that remains constant for a constant supply voltage.

2. A GaAs integrated circuit according to claim 1 in which the first diode means comprises two Schottky diodes and the second diode means comprises two Schottky diodes.

3. A GaAs integrated circuit according to claim 1 wherein the supply voltage is variable within a predetermined range, the voltage reference generator including:

a second depletion-mode FET having a gate, a drain coupled to the voltage reference node and a source coupled to the drain of the current-source connected FET; and second conductor means coupling the source of the current-source connected FET to the gate of the second FET for varying the gate voltage thereof;

the second FET being responsive to a variation in gate voltage to produce a corresponding variation in drain voltage of the current-source connected FET and thereby maintain drain-to-source voltage of the current-source connected FET substantially constant;

the current-source connected FET being operative in response to constant drain-to-source voltage to produce a current through the first diode means that is substantially invariant with supply voltage variations so that the first diode means provides a constant voltage drop to the reference voltage node.

4. A GaAs integrated circuit according to claim 3 in which the first and second diode means each comprise two diodes connected in series, the second conductor means being coupled to the source of the current-source connected FET through one of the diodes of the second diode means.

5. In a GaAs integrated circuit having a voltage reference generator including a voltage dropping means connected in series with a current-source connected FET to conduct current between a nominal ground node and a voltage supply node through a reference node between the voltage dropping means and a drain of the FET, a method of stabilizing voltage at the reference node against variations in operating temperature, comprising:

establishing a voltage difference between the gate and source of the current-source connected FET that is proportional to the voltage drop of the voltage dropping means; and varying the amount of current flow through the current-source connected FET in response to a variation in said voltage difference so as to compensate for any variation in voltage drop across the voltage dropping means due to temperature variations.

6. A method according to claim 5 in which the voltage dropping means comprises a Schottky diode, the step of establishing said voltage difference including connecting a Schottky diode in a current-source connecting loop from the source to the gate of the FET.

7. A method according to claim 6 in which the step of varying the amount of current flow includes positioning the diodes and current-source connected FET in adjacent locations within the circuit so that they operate under substantially similar temperatures.

8. In a GaAs integrated circuit, a GaAs voltage reference generator comprising:

a first voltage dropping means connected to conduct current from a nominal ground node to a voltage reference node;

a first depletion-mode FET connected in series with the first voltage dropping means, the first FET having a gate, a drain coupled to the reference node and a source coupled to a voltage supply node;

first conductor means coupling the gate of the first FET to the voltage supply node for current-source connecting the first FET to cause a current to flow between the ground node and the voltage supply node, the current being substantially constant for a constant voltage at the source of the first FET and a constant operating temperature of the integrated circuit;

a second depletion-mode FET connected in series with the first FET, the second FET having a gate, a drain coupled to the voltage reference node and a source coupled to the drain of the first, current-source connected FET; and second conductor means coupling the source of the first, current-source connected FET to the gate of the second FET for varying the gate voltage thereof;

the second FET being responsive to a variation in gate voltage to produce a corresponding variation in drain voltage of the first, current-source connected FET and thereby maintain drain-to-source voltage of the current-source connected FET substantially constant;

the first, current-source connected FET being operative in response to constant drain-to-source voltage to produce a current through the first voltage dropping means that is substantially invariant with supply voltage variations so that the first voltage dropping means provides a constant voltage drop to the reference voltage node.

9. A GaAs integrated circuit according to claim 8 including a second voltage dropping means connected to conduct current from the source of the first FET to the voltage supply node, between the first and second conductor means, for biasing the gate of the second FET to a voltage less than the supply voltage.

10. A GaAs integrated circuit according to claim 8 in which the first voltage dropping means includes a Schottky diode.

11. A GaAs integrated circuit according to claim 8 in which the voltage reference generator includes a second voltage dropping means connected to conduct current from the source of the first FET to the voltage supply node;

each of the voltage dropping means being operative to produce a voltage drop which varies within a predetermined range as a function of at least one of integrated circuit temperature and fabrication process variations;

the second voltage dropping means being coupled in a loop including the first, current-source connected FET and the first conductor means for establishing a voltage difference between the gate and source of the first FET that is proportional to the voltage drop of the second voltage dropping means;

the current-source connected FET being responsive to a variation in said voltage difference to vary said current so as to compensate for any variation in voltage drop across the voltage dropping means due to temperature or process variations and thereby provide a predetermined voltage at the voltage reference node that remains constant for a constant supply voltage.

12. A GaAs integrated circuit according to claim 11 in which the second voltage dropping means includes a Schottky diode.

13. In a GaAs integrated circuit having a voltage reference generator including a voltage dropping means connected in series with a first, current-source connected FET to conduct current between a nominal ground node and a voltage supply node through a reference node between the voltage dropping means and a drain of the FET, a method of stabilizing voltage at the reference node against variations in voltage at the voltage supply node, comprising:

connecting a second FET in series between the reference node and the drain of the current-source connected FET, the second FET having a gate; and biasing the gate of the second FET proportionally to the voltage at the voltage supply node;

the second FET being responsive to a variation in gate voltage to produce a corresponding variation in drain voltage of the current-source connected FET and thereby maintain drain-to-source voltage of the current-source connected FET substantially constant.

14. In a GaAs integrated circuit according to claim 13 wherein operation of the voltage reference generator can vary as a function of temperature, a method of temperature-stabilizing the voltage at the reference node, comprising:

establishing a voltage difference between the gate and source of the current-source connected FET that is proportional to the voltage drop of the voltage dropping means; and varying the amount of current flow through the current-source connected FET in response to a variation in said voltage difference so as to compensate for any variation in voltage drop across the voltage dropping means due to temperature variations.

15. A method according to claim 14 in which the voltage dropping means comprises a Schottky diode;

the step of establishing said voltage difference including connecting a Schottky diode in a current-source connecting loop from the source to the gate of the first FET; and the step of varying the amount of current flow including positioning the diodes and current-source connected FET in adjacent locations within the circuit so that they operate under substantially similar temperatures.

* * * * *